US005803092A

United States Patent [19]

Baltierra

[11] Patent Number: 5,803,092

[45] Date of Patent: Sep. 8, 1998

[54] CUTICLE PUSHER HAVING A CLAMSHELL HEAD

[76] Inventor: Julie Baltierra, 2243 Pacific Ave., No. 104-A, Costa Mesa, Calif. 92627

[21] Appl. No.: 840,989

[22] Filed: Apr. 22, 1997

[51] Int. Cl.[6] ..... A45D 29/00

[52] U.S. Cl. ..... 132/73; 132/75.3

[58] Field of Search ..... 132/73, 73.5, 75.3, 132/285

[56] References Cited

U.S. PATENT DOCUMENTS

| | | | |
|---|---|---|---|
| 1,289,952 | 12/1918 | Struble | 132/73 |
| 1,905,976 | 4/1933 | Wolf | 132/75.3 |
| 2,192,733 | 3/1940 | Bader, Jr. | 132/73 |
| 2,513,208 | 6/1950 | Rogers | 132/73 |
| 2,935,988 | 5/1960 | Floyd | 132/73 |
| 3,750,684 | 8/1973 | Russell | 132/73 |
| 4,559,957 | 12/1985 | Hokama | 132/73 |
| 4,930,529 | 6/1990 | Whitney | 132/73 |

FOREIGN PATENT DOCUMENTS

| | | | |
|---|---|---|---|
| 141337 | 9/1920 | United Kingdom | 132/73 |

*Primary Examiner*—Paul J. Hirsch
*Attorney, Agent, or Firm*—Leonard Tachner

[57] ABSTRACT

A cuticle pusher manicuring appliance which employs a pusher head having an upper member and a lower member with a rounded slot therebetween. The cuticle is captured in the slot while it is being pushed by the appliance. The lower member lifts the edge of the cuticle a precise distance from the nail surface while the upper member prevents the cuticle edge from being lifted above the slot. The dome structure of the upper member acts as an inhibitor, stopping the edge of the pusher from invading the matrix of the nail, a delicate area where the nail cells are produced.

7 Claims, 2 Drawing Sheets

CUTICLE PUSHER HAVING A CLAMSHELL HEAD

BACKGROUND OF THE INVENTION

1. Field of the Invention

The present invention relates generally to the field of manicuring appliances and more particularly to a cuticle pusher configured for pushing fingernail cuticles with reduced risk of tearing, and invading matrix where the nail cells are produced or otherwise injuring the delicate cuticle tissue.

2. Prior Art

It is well known in the manicuring art to first soften and then push cuticle tissue back toward the knuckle before cutting excess cuticle tissue to remove it from the nail. Pushing the cuticle tissue effectively lifts it off the fingernail surface, thereby making it accessible for cutting and removal. However, even after using a cuticle softening agent such as hand lotion, lanolin or even liquid soap, the delicate cuticle tissue is still susceptible to tearing, splitting or other such injury. Such injury is particularly likely to occur if the cuticle is inadvertently lifted too far while being pushed. Such lifting commonly causes tearing and splitting at the corners of the cuticle/nail interface which leads to bleeding and painful ruptures. Such ruptures detract from the appearance of the fingernail and often lead to infection. There is also the possibility of slipping or sliding the implement too far under the cuticle (especially with the use of lotions, soaps, etc.), which can cause injury. The dome-shaped head inhibits the edge from invading this area.

It would therefore be highly desirable to have a cuticle pusher manicuring appliance which reduces the risk of inadvertently lifting the excess cuticle tissue while it is being pushed back.

SUMMARY OF THE INVENTION

The present invention comprises a uniquely configured cuticle pusher manicuring appliance which employs a pusher head having an upper member and a lower member with a rounded slot therebetween. The cuticle is captured in the slot while it is being pushed by the appliance. The lower member lifts the edge of the cuticle a precise distance from the nail surface while the upper member prevents the cuticle edge from being lifted above the slot. In this manner, the upward movement of the cuticle is limited so that the risk of injury to the tissue as described above, is substantially reduced. An elongated, preferably tapered handle, provides a suitable gripping surface to control the pusher head.

OBJECTS OF THE INVENTION

It is therefore a principal object of the invention to provide a cuticle pusher manicuring appliance which reduces the risk of injury to delicate cuticle tissue and matrix area.

It is another object of the invention to provide a cuticle pusher manicuring appliance which restricts upward or lifting motion of the cuticle while the cuticle edge is being pushed for possible cutting and removal.

It is still an additional object of the invention to provide a cuticle pusher manicuring appliance with upper and lower pusher head members defining an arcuate slot therebetween for capturing the cuticle edge being pushed.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
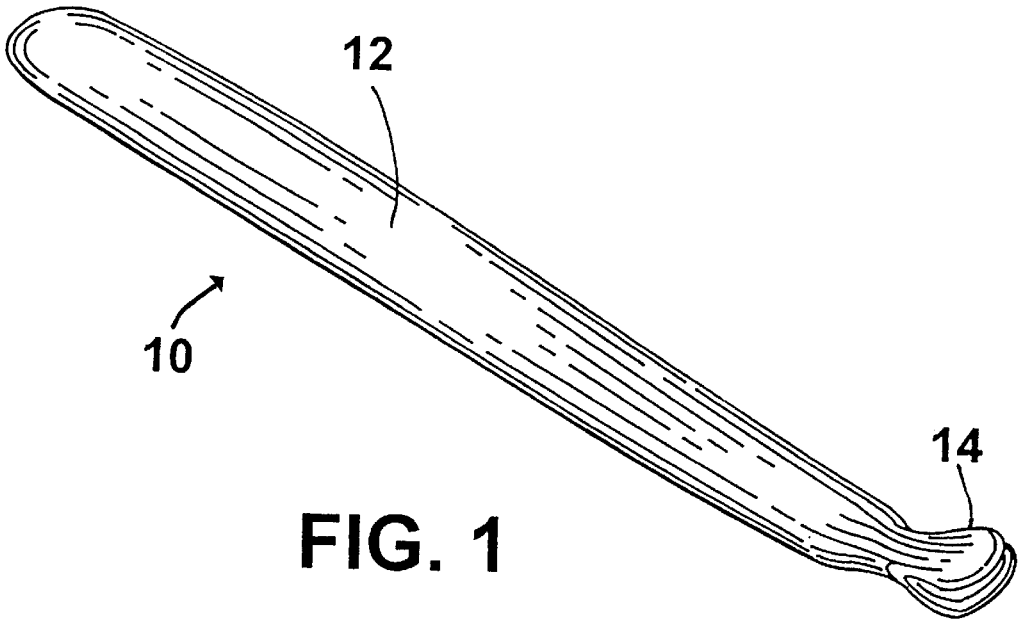
FIG. 1 is a three-dimensional view of a preferred embodiment of the invention.
Figure 2:
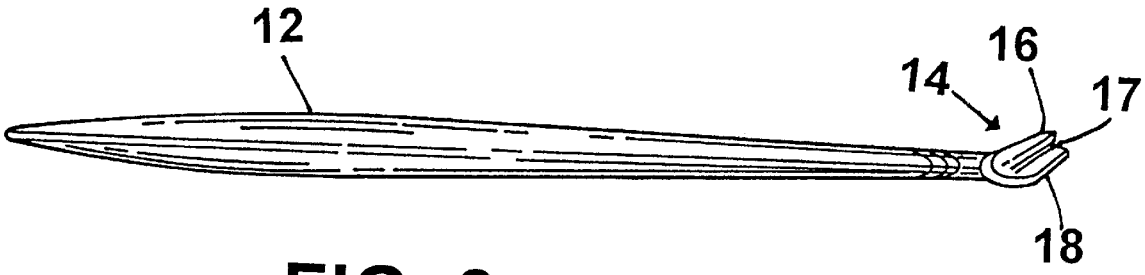
FIG. 2 is a side view thereof.
Figure 3:
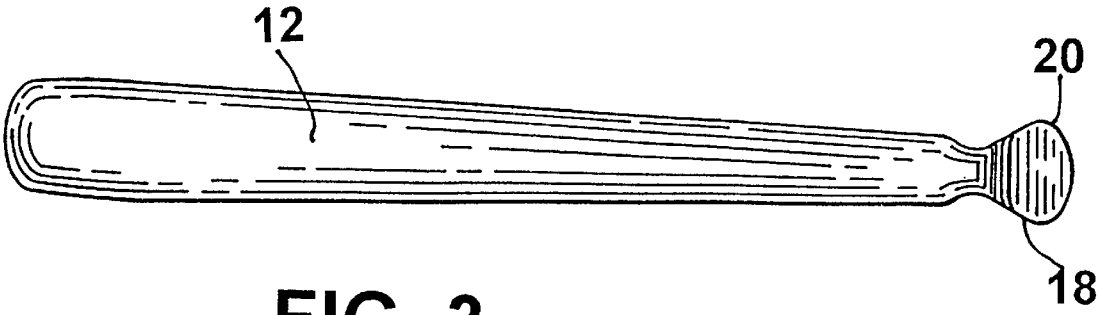
FIG. 3 is a top view thereof.
Figure 4:
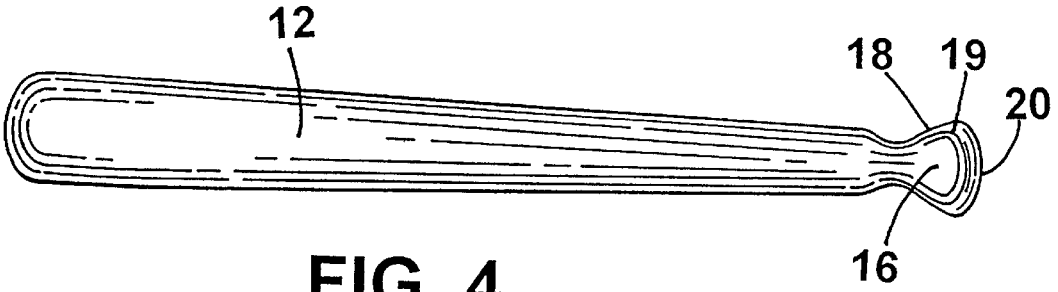
FIG. 4 is a bottom view thereof.
Figure 5:
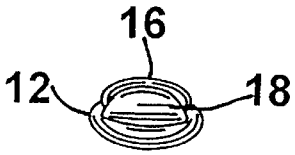
FIG. 5 is a head end view thereof.
Figure 6:
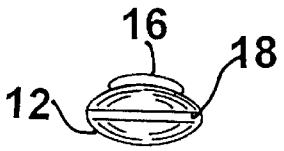
FIG. 6 is a handle end view thereof.
Figure 7:
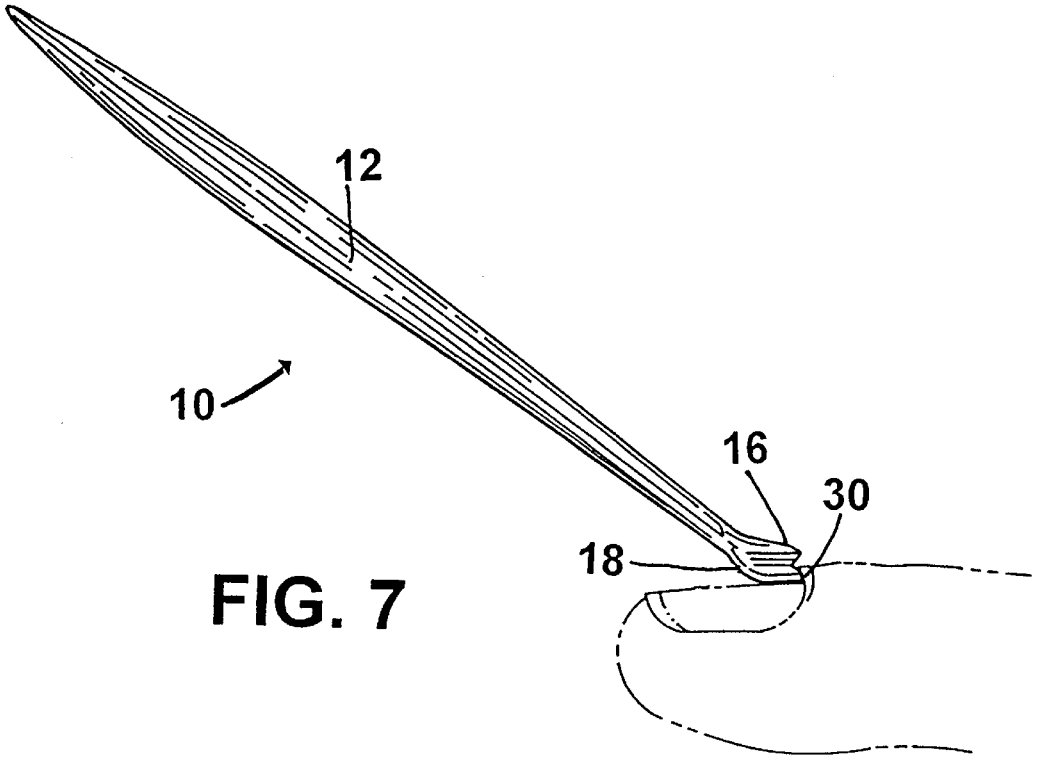
FIG. 7 is a side view showing the invention being used for pushing cuticle tissue of a fingernail.

Referring to the accompanying FIGS. 1–7, it will be seen that a preferred embodiment of a cuticle pusher 10 in accordance with the present invention, comprises a handle 12 terminating at one end in an integral pusher head 14. Head 14 has an upper member 16 and a lower member 18. Head members 16 and 18 are rounded at their respective edges 19 and 20 and are integrally joined in overlapping arrangement to form a curved slot 17 therebetween, thus forming a clamshell shaped head. Slot 17 is preferably convex across the front of the pusher head 14 from one side of the pusher 10 to the other and is preferably concave across the front of the pusher head from top to bottom. The convex shape is adapted to generally conform to the arcuate shape of the fingernail cuticle edges such as cuticle edge 30 shown in FIG. 7. The concave shape is adapted to receive the cuticle edge and effectively trap it between the upper and lower members while the lower member initially pushes and slips under the cuticle edge 30. The pusher head 14 thus lifts the cuticle edge, but only until the edge rests in the slot 17. Thereafter, the cuticle pushing force is directed primarily through slot 17 while the upper member 16 prevents any further lifting of the cuticle. Thus, it will be understood that the disclosed embodiment satisfies all of the objects of the invention listed hereinabove.

Having thus disclosed a preferred embodiment of my invention, it being understood that such an embodiment is merely one exemplary illustration of the novel features thereof, what I claim is:

1. A cuticle pusher apparatus which reduces risk of injury to a fingernail matrix and comprising:

an elongated handle having an end integral to a pusher head, said head having overlapping integral upper and lower members forming a slot between said members for engaging the edge of a cuticle with said lower member beneath said cuticle edge and said upper member limiting the lifting of said cuticle edge.

2. The apparatus recited in claim 1 wherein each of said upper and lower members has a rounded edge.

3. The apparatus recited in claim 1 wherein said slot has an arcuate shape.

4. The apparatus recited in claim 1 wherein said upper and lower members together form a clamshell shape.

5. The apparatus recited in claim 1 wherein said slot has a concave cross-section.

6. The apparatus recited in claim 1 wherein said handle is tapered.

7. A manicuring appliance comprising:

a clamshell-shaped cuticle pusher head affixed to an elongated handle; the head having a slot for engaging the edge of a fingernail cuticle.

* * * * *